United States Patent [19]

Lidster

[11] Patent Number: 4,545,836

[45] Date of Patent: Oct. 8, 1985

[54] METHOD OF MAKING A SET OF MARIMBA MALLETS

[76] Inventor: Daniel K. Lidster, 2010 Medford #D-33, Ann Arbor, Mich. 48104

[21] Appl. No.: 440,169

[22] Filed: Nov. 8, 1982

[51] Int. Cl.[4] ..... G10D 13/06; B65H 81/00

[52] U.S. Cl. ..... 156/185; 84/422 S; 156/229

[58] Field of Search ..... 84/422 S, 422 R, 404; 145/36; 273/67 R; 156/229, 184, 185, 186, 187, 242

[56] References Cited

PUBLICATIONS

Wexler Catalog of Musical Merchandise, So. Wabash, Chicago, Ill. 60605, 1965.

*Primary Examiner*—Michael Ball

*Attorney, Agent, or Firm*—Allegretti, Newitt, Witcoff & McAndrews, Ltd.

[57] ABSTRACT

An improved marimba/xylophone mallet, and method for making the same, in which a determined amount of liquid rubber is colored by a determined amount of pigment material. The colored liquid rubber is solidified into layer strips which are wrapped about a spheroid with the tightness of wrapping determined in association with the particular color of the pigmented rubber. A set of such mallets are formed with each mallet having a different color of mallet head varying in visual brightness for association in the mind of the musician as to corresponding musical brightness (timbre) of each mallet of the set.

5 Claims, 10 Drawing Figures

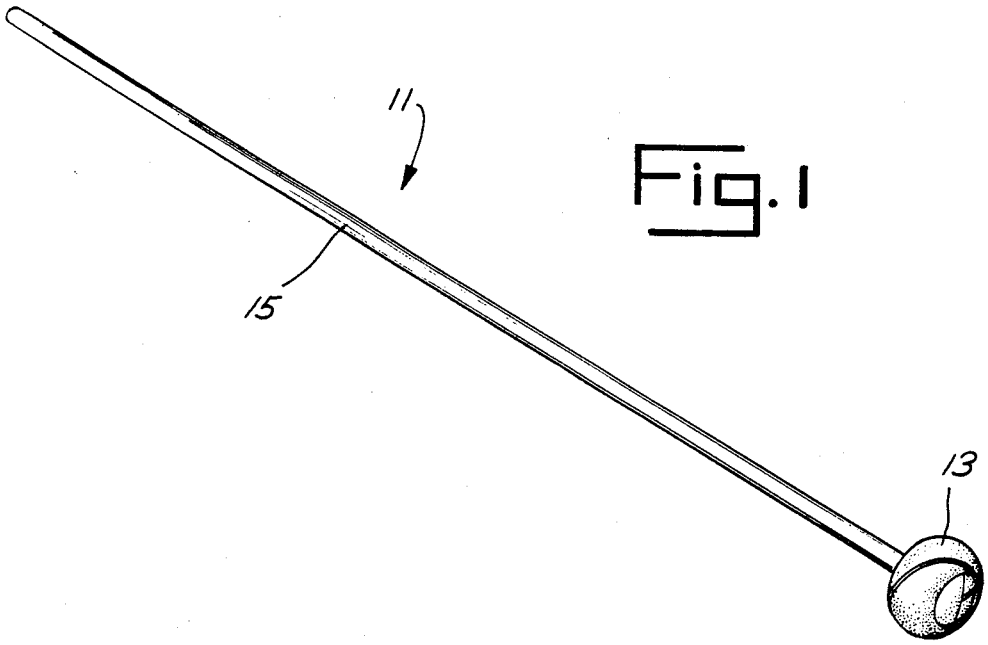
Fig. 1
Fig. 2
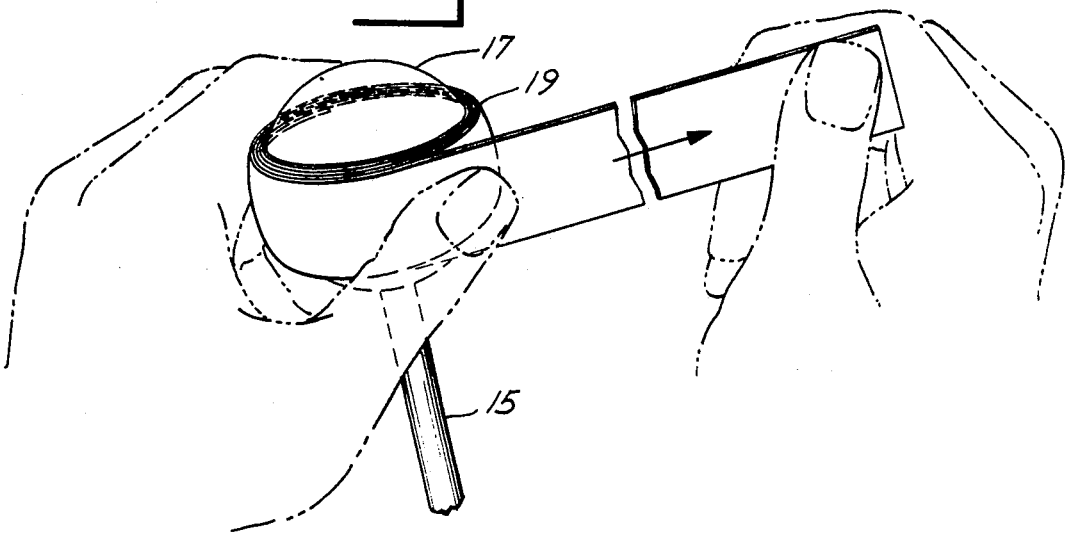
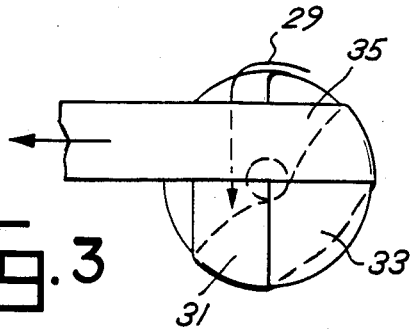
Fig. 3
Fig. 4
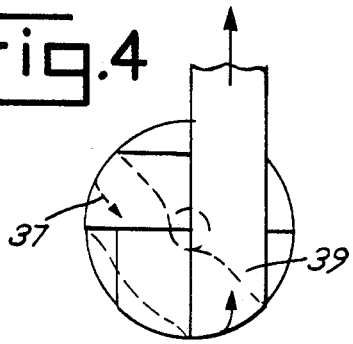

METHOD OF MAKING A SET OF MARIMBA MALLETS

BACKGROUND OF THE INVENTION

The invention relates to a percussion mallet for use with a xylophone or marimba and more particularly relates to improved apparatus and method for making a percussion mallet.

Originally, xylophone/marimba mallets were constructed from 100% virgin rubber wrapped onto the end of a mallet stick. The virgin rubber provides a "darker" musical sound (timbre) from the musical instrument than what is possible from other materials. Many of these early percussion mallets were manufactured in Guatamala where there exists a source of virgin rubber. In making the Guatamalan mallets, rubber strips were wrapped continually around the end of a mallet stick.

The diameter of the mallet head is varied to provide different amounts of mass to the head for using different mallets to play different ranges of pitches, produced by the mallet striking against the musical instrument. Different sized mallets are generally used at different parts of the instrument.

Thus, in the percussion art, musicians generally associate the musical tone to be produced by a mallet with the particular diametrical size of the mallet head. For example, if a musician desires to play a lower musical pitch, he would use a mallet having a large diameter head; if the musician wishes to play a higher pitch, he would use a mallet having a small diameter head. The musician thus has become habitized into selecting different diameter-head mallets in accordance with the pitch to be played.

It would be highly desirable to provide mallets of like sizes but which are able to be used to produce different tonal qualities. However, decreasing the size of the mallet head confronts the habit of the musician to equate head size with pitch selection.

It would be highly desirable to provide several mallets of standard size but with each mallet having a different timbre producing characteristic (despite head size) and at the same time overcome the head-size-to-frequency association in the musical field.

It is therefore an object of the present invention to provide an improved percussion mallet and method for making the same.

SUMMARY OF THE INVENTION

These and other objects of the invention are achieved in a mallet head being visually color associated with the tonal quality producing characteristics of the mallet, for example, timbre. The particular mallet head is formed from liquid virgin rubber which is colored by a determined amount of pigment material and formed into thin layer strips. The strips are wrapped in varying degrees of stretch intensity in order to vary the timbre produced by a mallet despite a fixed diameter of head size.

BRIEF DESCRIPTION OF THE DRAWINGS

FIG. 1 is a perspective view of a xylophone/marimba mallet of a preferred embodiment of the present invention.

FIG. 2 illustrates a wrapping step of a preferred method for making the mallet of FIG. 1.

FIGS. 3 through 8 illustrate the wrapping techniques utilized to form the mallet of FIG. 1.

DESCRIPTION OF THE PREFERRED EMBODIMENT

Figure 5:
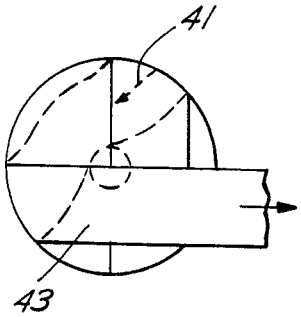

Referring to FIG. 1, a marimba mallet 11 is formed from a mallet head 13 positioned at one end of a mallet stick 15. As illustrated in FIG. 2, the making of the mallet head begins with a rubber or plastic sphere 17 which is glued or otherwise secured to one end of mallet stick 15. The sphere 17 serves as a mass which provides a foundation for carrying a plurality of rubber wrappings or layers 19. The layers are wrapped by hand at various stretch tensions in order to provide the mallet with a selected timbre producing characteristic. The particular manner of wrapping the head is described in more detail with reference to FIGS. 3–8.

Figure 9:
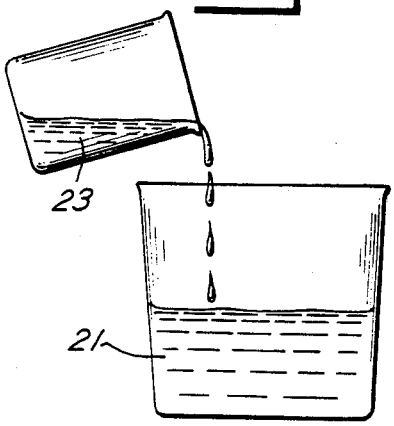
FIG. 9 illustrates a step of coloring the liquid rubber mixture utilized to wrap the mallet head of FIG. 1.

Referring to FIG. 9, the making of the mallet head begins with preferably 100% pure virgin rubber 21 in its liquid state, i.e., natural rubber from the Hevea tree. A pigment vehicle mixture (pigment material) 23 is poured into a determined quantity of liquid rubber 21 and thereafter the two are mixed thoroughly. For example, three to four teaspoons of the pigment material specified in the examples hereinafter may be mixed with 16 ounces of liquid rubber.

The particular pigment material utilized is a latex and preferably has water as its base. The material may vary depending upon the particular color desired. Some pigment materials which may be utilized are general latex paint mixtures (e.g. Fuller O'Brien water based latex) which may be described as follows:

| | |
|---|---|
| **Mixture 1** | |
| 8.35% Pigment | |
| Titanium Dioxide | 29.87% |
| Monoazo Yellow | 44.16% |
| Silica | 25.97% |
| | 100.00% |
| 91.65% Vehicle | |
| Acrylic Resin | 22.00% |
| Methyl Cellulose | .70% |
| Glycols | 6.45% |
| Water | 70.85% |
| | 100.00% |
| **Mixture 2** | |
| 12.21% Pigment | |
| Titanium Dioxide | 50.00% |
| Barium Sulphate | 50.00% |
| | 100.00% |
| 87.79% Vehicle | |
| Acrylic Resin | 26.23% |
| Glycols | 14.01% |
| Methyl Cellulose | .52% |
| Water | 59.24% |
| | 100.00% |
| **Mixture 3** | |
| 15.4% Pigment | |
| Titanium Dioxide | 87.10% |
| Barium Sulphate | 12.90% |
| | 100.00% |
| 84.60% Vehicle | |
| Acrylic Resin | 26.20% |
| Glycols | 14.20% |
| Methyl Cellulose | .35% |
| Water | 58.85% |

-continued

| | |
|---|---|
| | 100.00% |
| Mixture 4 | |
| 15.42% Pigment | |
| Titanium Dioxide | 17.42% |
| Red Iron Oxide | 41.94% |
| Yellow Iron Oxide | 40.64% |
| | 100.00% |
| 84.58% Vehicle | |
| Acrylic Resin | 25.16% |
| Methyl Cellulose | .49% |
| Glycols | 6.87% |
| Water | 67.48% |
| | 100.00% |

The particular % given above are percentages by volume.

Some present suppliers of liquid rubber mix an antioxidant in with the liquid rubber in order to slow the aging process of the rubber. Such a liquid rubber with an anti-oxidant may be used in accordance with the embodiment herein described.

Figure 10:
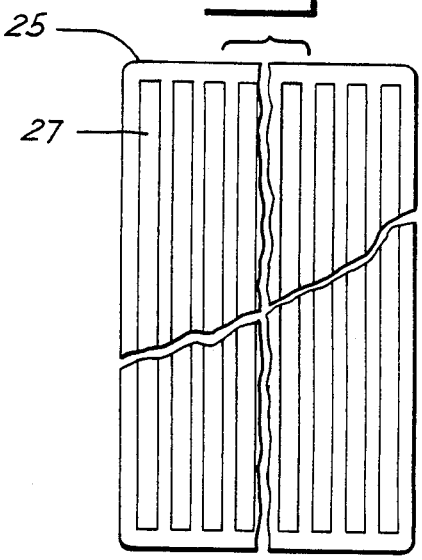
FIG. 10 illustrates the forming of the liquid rubber mixture into strips for making the mallet head of FIG. 1.

After the pigmented latex 23 has been thoroughly mixed with liquid rubber 21, the mixture will be of one color. As illustrated in FIG. 10, the colored mixture is poured into a mold 25 to form a plurality of strips 27 having a predetermined size, for example, 0.048" depth, 1" width, and various lengths as desired. Examples of length sizes include 50", 26", 21", 11" and 8".

The mixture is permitted to solidify such that the layer strips 27 become solid rubber. The strip 27 is self-adhesive and sticks to itself as the strip is wrapped in layers to form the mallet head.

The rubber spheroid 17 is wrapped with a predetermined number of wraps and the tightness of successive wrappings are varied in association with the particular colored pigment of the pigmented latex. This provides the mallet head with a particular timbre producing quality which is to be associated with the particular visual color of the mallet.

In wrapping the mass of the spheroid 17, a first step of wrapping is performed in which the rubber strip is initially wrapped around the perimeter of the ball a plurality of revolutions at a fixed stretch intensity, as shown in FIG. 2. For example, a one-inch diameter spheroid may be wrapped with a one-inch width strip counter-clockwise for 4 and ½ times around the perimeter of the rubber ball. During the initial step the rubber strip is not stretched, but is wrapped in its relaxed state.

Figure 6:
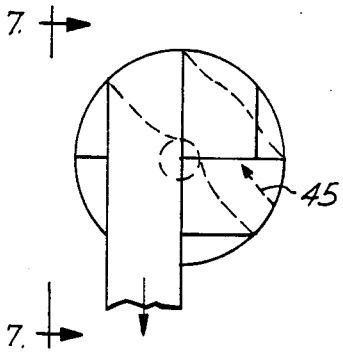
Figure 7:
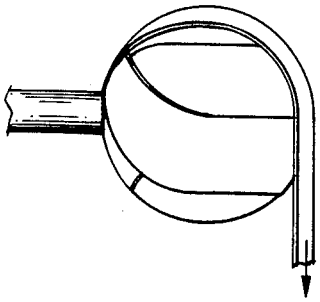

Next, a second step of wrapping is performed in which the rubber strip is pulled up across the top of the ball, as shown at 29 in FIG. 3, in a first pass 31 overlapping one side of the top of the ball. The strip is pulled down underneath the bottomside of the ball and across one side of the ball generally tangent to the mallet stick, as shown at 33. The pass on the underneath side of the ball is generally at an angle to the first pass 31 across the top of the ball. The angle of the pass across the bottom of the ball permits the strip to be next pulled back up and across the top of the ball in a second pass 35 substantially perpendicular to first pass 31. The strip is pulled down underneath one side of the ball (as shown at 37, FIG. 4) and at an angle to second pass 35. The strip is pulled back up across the top in a third pass 39 substantially parallel to the first pass 31. The strip is then pulled down underneath one side of the ball (at 41, FIG. 5) and across the underneath portion of the ball. The strip is then pulled back up and across the top of the ball in a fourth pass 43 substantially parallel to the second pass 35. The strip is then pulled underneath the ball at 45, providing the fourth pass to the bottom. The rubber then may be pulled over top of the first pass 31, as shown in FIG. 6, and side view in FIG. 7. This provides a covering across the top and underneath side of the ball holding the perimeter wrappings to the ball surface.

The wrapping to cover the upper and lower portion of the ball are performed with the rubber stretched. The more the stretch the "harder", less resilient, the head. Thus, tighter stretching wraps give the mallets a brighter (timbre) sound, whereas less tight stretching wraps give the mallets a darker (timbre) sound.

Next, the first step of wrapping is repeated for wrapping the perimeter a second time with a plurality of revolutions of the strip. For example, five revolutions of the strip are next formed to wrap the perimeter. Again, the wrapping of the perimeter is performed with the rubber strip in its unstretched and relaxed state.

Figure 8:
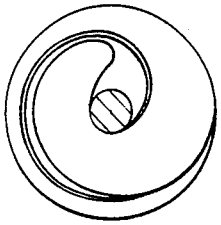

Finally, the second step of wrapping is performed again for covering the top and bottom of the ball. The wrapping of the mallet is completed by carrying the rubber strip down to the underneath side of the ball at a gentle angle from the perimeter, as illustrated in FIG. 8. The rubber strip adheres to the underside of the mallet by its self-adhesive nature.

Using a 21 inch length strip to wrap the spheroid 17 by the four above steps, and using a stretch intensity so that the full length of strip is used, is an example of a mallet producing a particular timbre. Also using a 26 inch length strip so that the entire length of strip is used, results in a mallet producing a different timbre.

Since "brightness" in sound is a term used to specify timbre, this association may be utilized by coloring the rubber for separate mallets using bright colors (more light reflective, e.g. white, cream color, etc.) and using dark colors (more light absorbive, e.g. brown, light brown, etc.) in association with the "brightness" of the timbre produced. One example would be to have a plurality of mallets (say 4 or more) and with each mallet head colored from dark brown to white, e.g. dark brown, brown, cream-colored, white, and with varuing timbre respectively from a darker sound for the dark brown mallet to a bright sound for the white mallet. Thus, the musician could select a particular timbre producing quality by selecting mallets on the basis of color.

Also, the timbre of the mallet may be varied depending upon the hardness of the spheroid 17, e.g. the spheroid may be formed of rubber, as the example above, or may be formed of plastic. As will suggest itself; a softer material could be used for the spheroid, which will affect the timbre.

It is to be understood, of course, that the foregoing describes a preferred embodiment of the present invention and that modifications may be made therein without departing from the spirit or scope of the present invention as set forth in the appended claims.

What is claimed is:

1. A method of making a set of xylophone/marimba mallets comprising a plurality of mallets each having a different visual color of mallet head of approximately the same size and each said mallet having a different timbre producing characteristic including the steps of:

measuring a determined amount of liquid rubber for each mallet;

measuring a determined amount of different pigment materials, associating each pigment material with an individual mallet;

mixing each pigment material and the measured rubber for each associated mallet, until the respective pigment material is thoroughly dispersed in its respective mixture;

forming each of the liquid mixtures into at least one solid layer strip;

securing a mass to each end of each of a plurality of mallet sticks;

wrapping at least one strip of a respective pigment mixture around the respective mass of the associated mallet, for each mallet, to form the mallet heads, said step of wrapping including wrapping the mass of an associated mallet with a determined number of wraps and with the tightness of wraps determined in association with the particular color of the pigment material of the layer strip wherein the different timbre is achieved by wrapping strip of the same rubber at different stretch intensity.

2. A method according to claim 1 and further including the step of providing different pigment materials, a substantial portion of each of which is comprised of acrylic resin, glycols, methyl cellulose and water.

3. A method according to claim 1 and further including the step of providing an associated mass for each mallet, each said mass being a molded rubber ball.

4. A method according to claim 1 wherein said step of wrapping each mass includes:

a first step of wrapping the rubber strip around the perimeter of the ball a plurality of revolutions at a first stretch intensity;

a second step of pulling the strip at a second stretch intensity different than the first stretch intensity in a first pass across the top of the ball and down underneath one side of the ball and back up and across the top in a second pass orthogonal to the first pass and down underneath one side of the ball and back up and across the top in a third pass parallel to the first pass and down underneath one side of the ball and back up and across the top in a fourth pass parallel to the second pass;

repeating said first step of wrapping;

repeating said second step of pulling; and attaching the strip to the underside of the mallet.

5. A method according to claim 1 wherein said step of wrapping for each mass includes:

wrapping the rubber strip around the perimeter of the mass to give radial curvature to the outer perimeter of the mass;

wrapping the strip across the top of the mass and continuing underneath the mass to cover the top and bottom surfaces of the mass;

repeating the last two named steps to provide the wrapped mass with a determined diameter; and substantially varying the stretch intensity of the strip during wrapping to control the timbre producing affects of the mallet.

* * * * *